United States Patent [19]

Matayoshi et al.

[11] Patent Number: 5,048,474

[45] Date of Patent: Sep. 17, 1991

[54] VALVE TRAIN FOR AUTOMOTIVE ENGINE

[75] Inventors: Yutaka Matayoshi, Yokosuka; Shigeru Kamegaya, Tokyo; Shigeru Sakuragi, Yokosuka; Hiroshi Komatsu, Zushi; Kozaburo Okawa, Yokohama, all of Japan

[73] Assignee: Nissan Motor Co., Ltd., Yokohama, Japan

[21] Appl. No.: 479,621

[22] Filed: Feb. 13, 1990

[30] Foreign Application Priority Data

| | | | |
|---|---|---|---|
| Feb. 22, 1989 | [JP] | Japan | 1-42739 |
| Mar. 1, 1989 | [JP] | Japan | 1-49176 |
| Mar. 6, 1989 | [JP] | Japan | 1-53263 |
| Mar. 9, 1989 | [JP] | Japan | 1-57388 |

[51] Int. Cl.[5] ..... F01L 1/30

[52] U.S. Cl. ..... 123/90.18; 123/90.24; 123/90.39

[58] Field of Search ..... 123/90.18, 90.24, 90.25, 123/90.26, 90.39

[56] References Cited

U.S. PATENT DOCUMENTS

| | | | |
|---|---|---|---|
| 1,633,882 | 6/1927 | Ballot | 123/90.25 |
| 2,015,135 | 9/1935 | Brady | 123/90.39 |
| 2,833,258 | 5/1958 | Lorscheidt et al. | 123/90.24 |
| 3,098,472 | 7/1963 | Hoenick | 123/90.24 |
| 3,254,637 | 6/1966 | Durham | 123/90.25 |
| 3,430,614 | 3/1969 | Meacham | 123/90.24 |
| 3,626,469 | 12/1971 | Ashley | 123/90.25 |
| 4,352,344 | 10/1982 | Aoyama et al. | 123/90.18 |
| 4,357,917 | 11/1982 | Aoyama | 123/90.16 |
| 4,583,498 | 4/1986 | Magnet | 123/90.18 |
| 4,693,214 | 9/1987 | Titolo | 123/90.18 |
| 4,796,483 | 1/1989 | Patel et al. | 74/519 |

FOREIGN PATENT DOCUMENTS

| | | | |
|---|---|---|---|
| 91804 | 10/1983 | European Pat. Off. . | |
| 53-51928 | 12/1978 | Japan . | |
| 55-96310 | 7/1980 | Japan . | |
| 60-3412 | 1/1985 | Japan . | |
| 0030406 | 2/1985 | Japan | 123/90.24 |
| 60-32910 | 2/1985 | Japan . | |
| 60-32911 | 2/1985 | Japan . | |
| 61-6611 | 1/1986 | Japan . | |
| 61-11408 | 1/1986 | Japan . | |
| 886151 | 1/1962 | United Kingdom . | |
| 1051107 | 12/1966 | United Kingdom . | |

OTHER PUBLICATIONS

C. A. Schiele et al., "Design and Development of a Variable Valve Timing (VVT) Camshaft", Society of Automotive Engineers, Feb. 25–Mar. 1, 1974, pp. 1–9.

MTZ, May 1986, pp. 185–188.

*Primary Examiner*—David A. Okonsky

*Assistant Examiner*—Weilun Lo

*Attorney, Agent, or Firm*—Foley & Lardner

[57] ABSTRACT

In a valve train for an I.C. engine, a cam shaft has cams formed with compound curvatures which allow the valve timing to be altered while the engine is operating, to suit the engine driving conditions by shifting the cam shaft along its axis. To reduce the force necessary to shift the cam shaft along its axis the valve closure springs are replaced by closure cams. In some embodiments pivoting arrangements comprising a pair of ball and socket joints are provided to eliminate lateral sway of the rocker arms allowing precise adjustment of the valve timing when the cam shaft is shifted along its axis. In other embodiments the rocker arms are journalled on a rocker shaft provided with stops for preventing lateral sway. In some embodiments the closure rocker arms have cupped ends in which either the valve stem retainer or the valve stem seal is received.

14 Claims, 12 Drawing Sheets

VALVE TRAIN FOR AUTOMOTIVE ENGINE

BACKGROUND OF THE INVENTION

1. Field of the Invention

The present invention relates generally to an internal combustion engine valve train and more specifically to a poppet valve control arrangement which features a pair of rocker arms which are arranged in a scissor-like manner and wherein one of the arms is used to lift the valve while the other is used to close the same and wherein a cam arrangement is provided by which the valve timing can be variably adjusted in accordance with vehicular driving conditions.

2. Description of the Prior Art

Mechanisms are known in the art of internal combustion engines for adjusting the timing of the induction and exhaust valves in a manner so as to best meet the particular conditions under which the engine is being operated. Such systems are generally adapted to be operable to provide the most efficient valve timing for slower or faster engine ranges.

An example of one such prior art valve timing adjustment system may be found in JP-A-55-96310.

In the above mentioned mechanism, the cam for lifting the poppet valve is formed so as to have a profile which changes along the longitudinal axis of the cam shaft. Thus, the cam face defines a compound curve and may be referred to as a compound cam.

The cam shaft, on which the compound cam is formed, is axially movable along its rotational axis so as to facilitate the adjustment of the valve timing. As the cam shaft on which the compound cam is moved along its rotational axis the profile of the peripheral portion of the cam which comes into engagement with the cam follower changes. In this manner both the valve lift and the valve timing can be changed.

For example, it may be deemed desirable to cause the valve to be opened to a lesser degree and for a shorter period of the engine cycle during low speed/low load operation of the engine in order to provide greater fuel efficiency. On the other hand, it may be desirable to operate the cam into a position wherein the valve stroke and the cycle duration of valve opening may be lengthened during the high speed operation of the engine in order to provide the maximum power output and to improve the intake and exhaust efficiency.

In the above mentioned system problems exist in that, with most conventional poppet valve opening mechanisms the valve is opened by a cam and is returned to the closed position by a spring. Because of this spring, a large force is generally required in order to open the valve against the closure pressure of the valve closure spring. Therefore, in order to move the compound cam along its axis against the friction and pressure exerted thereon by the valve closure springs, a rather large motive force is required.

It is particularly difficult to move the cam shaft along its axis against the increased friction that is generated while the valves are in the open positions, since it is then that the maximum degree of pressure is being exerted on the cams through the cam followers by the valve closure springs.

Thus, in order to assure that the cam shaft can be moved along its axis quickly enough so as to adjust the valve timing in such a manner as to keep up with the rapidly transient changes which occur when operating the engine of an automobile, the motive force to drive the cam shaft along its axis for adjusting the compound cam becomes even larger.

In view of the above problems related to reducing the motive force required for driving the cam shaft along its axis it had been proposed during the development of the present invention, to actuate the cam shaft to move during the moment of least friction between the cams and the cam followers. This moment being that when the portions of the cams which are at the smallest distance from the axis of the cam shaft are in contact with or slightly disengaged from the cam followers.

Unfortunately, in engines having a large number of valves, the length of time for which these smallest portions of the cams are all in engagement with the cam followers, i.e. when the valves are all closed, is extremely short and timing the movement of the cam shaft to coincide with this moment of least friction is exceedingly difficult.

Another problem encountered in the above system is that the cam surface is formed with sections having varying angles with respect to the axis of the cam shaft. As a result, if the cam follower is mounted solidly on the tip of the rocker arm or the valve stem, there is point contact between the cam follower rather than the line contact conventionally sought after. This type of engagement results in a high concentration of friction at the contact point resulting in extremely rapid wear on the cam follower and on the cam.

On the other hand, attempts have been made to make line contact between the cam follower and the cam by providing a swiveling tip on the cam follower that can pivot so as to remain as nearly flat against the varying contours of the cam as possible. The provision of such a swiveling tip however adds weight as well as making the cam follower prohibitively complex and expensive.

Attempts have also been made in the prior art as in shown in JU-A-60-3412 and JP-A-60-32910 to provide a mechanism whereby the induction or exhaust valve of an internal combustion can be made to open and close stably when the engine is running very fast. In order to achieve this aim, the above valve opening mechanisms comprise a cam shaft on which a opening cam and a closure cam are fixedly mounted in a side by side relationship.

A rocker shaft supports an opening rocker arm and a closure rocker arm. The opening rocker arm is provided with an adjust screw via which the valve clearance can be adjusted.

A poppet valve, which can be either an inlet valve or an exhaust valve, has a stem the top of which is provided with a retainer. The retainer is formed with a radially extending flange at the bottom thereof, which is arranged to be engaged by the leading or outboard end of the closure rocker arm. The end of the rocker arm is formed with a U-shaped recess which defines two bifurcate finger members. These fingers extend on either side of the valve stem and engage the bottom of the retainer.

In operation, as the cam shaft rotates, the opening and closure cams rotate to positions wherein the high and low lift portions thereof engage the opening and closure rocker arm followers. This induces the opening rocker arm to rotate in a direction which brings the end of the adjust screw into engagement with the top of the valve stem and applies a force which tends to move the valve head off the valve seat. Simultaneously, the closure rocker arm is rendered rotatable in the same direction as the opening rocker arm, and thus relaxes the force which tends to bias the valve head into engagement with the valve seat.

Accordingly, the valve head is moved to an open position.

As the cam shaft continues to rotate, the low lift and high lift portions of the opening and closure cams come into contact with the followers of the opening and closure rocker arms, respectively. This causes the closure rocker arm to rotate in a direction which forces the lead end thereof against the lower face of the retainer and produces a force which moves the valve upwardly and which permits the opening rocker arm to be rotated in the same direction. The valve is thus moved until the valve head engages the valve seat and closes the valve.

In another arrangement, the opening rocker arm is arranged to engage a flanged retainer at its leading end and to have a follower formed thereon at a location distal from the axis about which it is pivotally mounted. The closure rocker arm is pivotally mounted on the same rocker shaft as the opening one, and provided with a clearance adjust screw which is arranged to engage a portion of the opening rocker arm located proximate the shaft on which the two rocker arms are pivotally mounted.

With this arrangement, as the cam shaft rotates essentially the same type of push-pull type of operation as in the previous arrangement occurs and the valve is opened and closed.

For further disclosure relating to such types of arrangements, reference can be had to JU-A-60-3412 and JP-A-60-32910.

However, the above valve train driving mechanisms have the disadvantages that the cam clearances for both the opening and the closure rocker arms must be set very precisely and the clearance adjuster mechanisms are both complicated to build and difficult to adjust. This makes the valve train expensive to manufacture and maintain.

What is more, with the passing of time, the valve heads and seats tend to undergo localized wear and/or deterioration. This, as is well known, leads to the loss of sealing by the valve and invites loss of efficiency and proper engine operation. These arrangements have also suffered from the drawback that both of the clearances between the opening and closure rocker arms and the portions of the valve and the retainer which they engage, is difficult to set and maintain. Accordingly, these type of arrangements have tended to be noisier than the conventional spring loaded types.

In view of the above problems the inventors of the present invention proposed a valve driver mechanism in which the clearance adjusting operations were simplified in JU-63-203521.

In the latter application, a rocker arm mechanism was proposed wherein the opening and the closure rocker arms are pivotably connected to each other by means of a pin and one of the rocker arms is pivotably connected to the cylinder head by a ball and socket pivot connection so as to pivot on an axis that is parallel to the pivoting axis defined by the connection between the opening and closure rocker arms. In this mechanism, by adjusting the position of ball of the ball and socket joint, the valve clearance for both the opening and closure cams can be carried out in a single simple operation.

The latter device while facilitating easy adjustment of the rocker arm clearances has the drawbacks that, since the connection between the cylinder head and the rocker arm unit is formed by a single ball joint, the rocker arms have a tendency to sway side to side about the ball and socket joint and or to tilt out of the proper rocking plane. Thus the later rocker arm pivot mechanism suffers the disadvantage of providing little or no lateral or vertical stability to the rocker arms.

These tendencies of the rocker arms to tilt and vibrate lead to accelerated wear of the cam and cam follower surfaces and widen the clearances resulting in noisy valve opening operation. This was particularly problematic when the engine is running fast and even a small magnitude of vibration tended to create a great deal of noise. What is more, this lateral and vertical play in the rocker arms tends to disrupt the valve timing and valve seating and makes precise adjustment of the valve timing impossible.

Thus, the complexity and the resulting expense of building and as well as the difficulty of maintaining the valve clearance adjustment of the above mentioned 'desmo-dronic' type valve control rocker assemblies, as well as the magnitude of noise they create due to the resulting cam clearances has somewhat restricted their field of application to high performance and racing type engines in which noise and labor intensive maintenance are taken as a matter of course.

In such engines, since they are generally designed to be operated in a range referred to as the power band, idling and low range fuel efficiency is generally not a major consideration. On the other hand, weight and compactness are a high priority design factors. Therefore the application of an adjustable compound cam shaft and the associated weight and bulk in an engine having a desmo-dronic type valve control rocker assembly has not to date been proposed due to the conflicting design objectives.

On the other hand, the attempt to provide a simplified rocker arm arrangement by providing the adjustable ball and socket type pivot seemed to hold the promise of bringing the desmo-dronic type valve control arrangement having the closure cam as a replacement for the valve closure spring into the realm of the middle class of automotive engine. Unfortunately, this raised the problems of lateral and vertical pivoting instability in the rocker arms.

What is more, due to this lateral and vertical instability, the application of the ball and socket type rocker arm pivot arrangement in association with a cam shaft movable along its axis posed apparently insurmountable complications in that the movement of the cam shaft along its axis would drive the ends of the rocker arms to sway side to side with the result that the cam followers would not change positions on the compound cams as intended. This also had the result of causing the rocker arms to exert a large lateral force on the valve stems that could cause a great deal of wear and/or even bend them.

SUMMARY OF THE INVENTION

It is an object of the present invention to provide a valve train arrangement which can be variably timed by using suitably contoured cams which are mounted on an axially movable cam shaft, in combination with a scissor type rocker arm arrangement wherein one of the arms controls the opening or lifting of a valve or valves and the other controls the closure of the valve.

The opening cam and the closure cam each have surface portions which are formed at an angle with respect to the axis of the cam shaft and thus define compound cams.

In such embodiments, when the valve stroke and/or the valve timing are to be altered, the cam shaft is driven along its axis such that the profile of the portions of the cams which are being engaged by the cam followers is altered. In this manner the currently used cam profile can be selectively varied to suit the current operating conditions of the engine.

In this arrangement, as the closure spring provided in the conventional poppet valve closure mechanism is dispensed with in favor of the closure cam, the friction between the cam followers and the cam surface is greatly reduced. For this reason the resistance to linear motion of the cam shaft is greatly reduced. Further, this reduction in friction allows the cam shaft to be driven smoothly and quickly along its axis for altering the valve opening characteristics with a minimum of motive force.

Another feature of the invention is that the cam followers are formed integrally on the rocker arms so as to define convex surfaces. This prevents any tendency of the cam followers to hang up or catch on any sharp corners of the cams when the cam shaft is driven along its axis, thus assuring smooth shifting of the cam shaft.

This induces the situation wherein the cam followers are in point contact with the cams. However, since a closure spring is not provided, the engagement between the cam followers and the cams is light so there is a reduced tendency for the cams to and cam followers to wear.

According to another feature of the invention, in order to provide lateral stability to the rocker arms, in place of a single ball joint, a pair of ball and socket joints arranged along an axis running parallel to the cam shaft, are provided by which the rocker arm assembly is coupled to the cylinder head. The rocker arm assembly is therefore prevented from pivoting laterally and attenuates sway as well as tilting thus greatly reducing engine noise and enhancing valve timing precision.

According to a further feature of the invention, the end of the closure rocker arm is formed with a cupped portion in which the valve stem retainer cap is reived. The walls of the cupped portion lend it vertical rigidity so that the bottom can be made thin. In this manner the clearance between the valve stem retainer cap and the oil seal on the valve stem sleeve can be reduced so that the valve stem can be made shorter.

According to one aspect of the invention, an adjustable valve train for an internal combustion engine comprises a cam shaft which operatively connected with a crank shaft of the engine, an opening cam and a closure both being formed so as to have a cam profile which varies along the axis of the cam shaft, axial driving means for driving the cam shaft along its axis, an opening rocker arm having a valve stem engaging a portion of a valve stem of a poppet valve for exerting a force thereon in an opening direction, an opening cam follower formed on said opening rocker arm for engagement with the opening cam, a closure rocker arm having a valve stem engaging portion for engaging a valve stem of a poppet valve for exerting a force thereon in a valve closing direction, and a closure cam follower formed on the closure rocker arm for engagement with said closure cam.

The closure and opening cam followers may have convex crowns.

The profile of the closure cam may be such that when the valve stem is urged in the closing direction by the closure rocker arm in response to the rotation of the cam shaft, it moves at a rate that causes the valve stem to exert a force on the valve stem engaging portion of the opening rocker so as to cause the opening cam follower to pivot so as to be maintained in engagement or near engagement with a non-thrust face portion of the opening cam.

According to another aspect of the invention a valve train for an internal combustion engine comprises a cam shaft driven to rotate at a rate directly proportional to the crank shaft, an opening cam, a closure cam, an opening rocker arm having a valve stem engaging portion for urging a valve stem in an opening direction, an opening cam follower formed on said opening rocker arm for engagement with said opening cam, a closure rocker arm having a valve stem engaging portion engaging a valve stem of a poppet valve for exerting a force thereon in a valve closing direction and the closure rocker arm being pivotally mounted to the opening rocker arm so as to pivot with respect thereto along a first axis, a closure cam follower formed on said closure rocker arm for engagement with the closure cam, and a pair of ball and socket pivots pivotably coupling either the opening or closing rocker arm to the cylinder head and defining a second pivoting axis about which it pivots with respect to said cylinder head.

According to a further aspect of the invention, a closure rocker arm for an internal combustion engine comprises a valve stem closure portion having a horizontally extending web portion engaging a valve stem of a poppet valve for exerting a force thereon in a valve closing direction, and a flange portion extending at a side of the horizontally extending web portion at a substantially right angle thereto for stiffening the web portion.

A pair of flange portions may extend at either side of the web portion so that a valve stem retainer member or a valve stem seal is accommodated therebetween.

Another aspect of the present invention is deemed to comprise a variable valve timing arrangement for operating a valve of an internal combustion engine which features a rotatably driven camshaft, the cam shaft being supported in the engine so as to be axially displaceable therein servo means for selectively displacing the cam shaft along the axis thereof first and second cams mounted on the cam shaft, the first and second cams having first and second predetermined cam configurations a first rocker arm operatively interconnecting the valve and the cam shaft, the first rocker arm being arranged to be motivated by the first cam in a manner to open the valve; a second rocker arm operatively interconnecting the valve and the cam shaft, the second rocker arm being arranged to be motivated by the second cam in a manner to close the valve; and means associated with the first and second rocker arms for obviating movement thereof in the axial direction of the cam shaft.

DETAILED DESCRIPTION OF THE PREFERRED EMBODIMENTS

Figure 1:
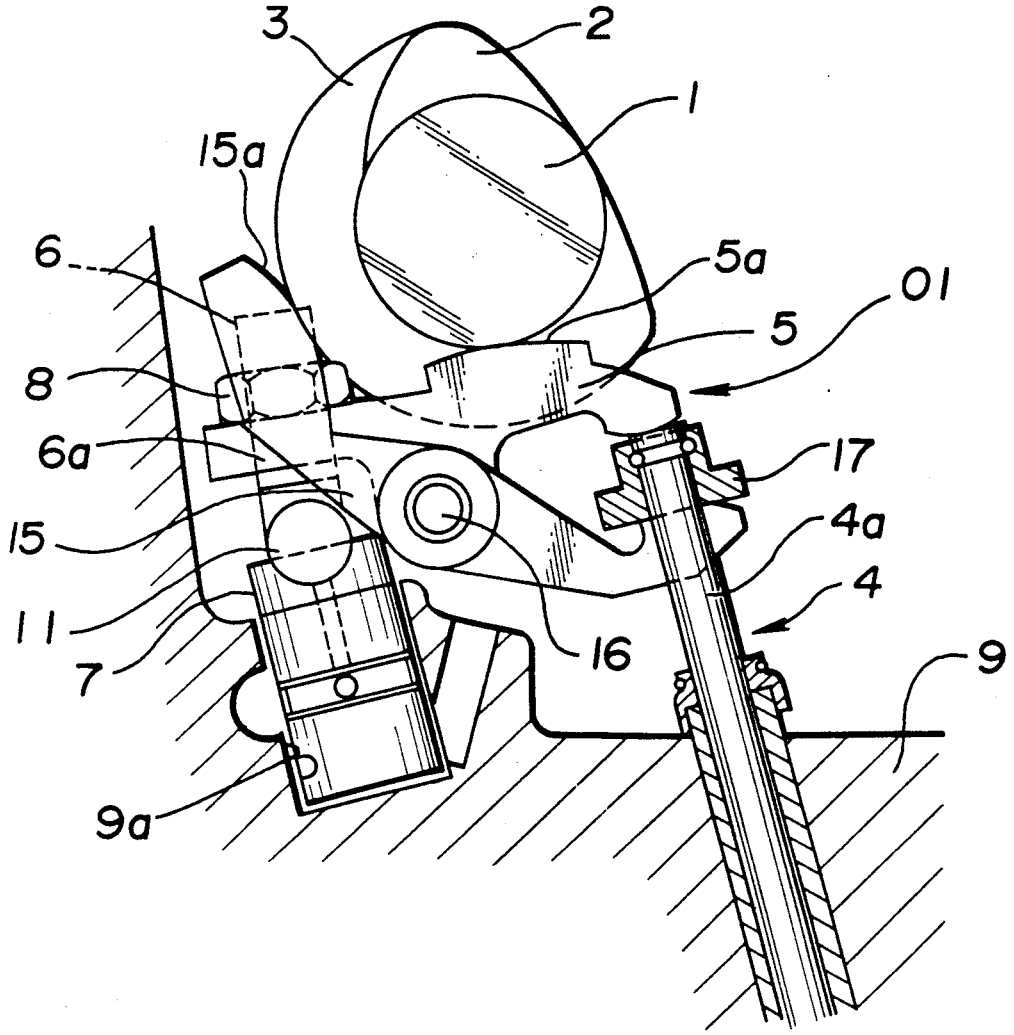
FIG. 1 is a side elevation, partially in section showing a first embodiment of a rocker arm assembly according to the present invention.
Figure 2:
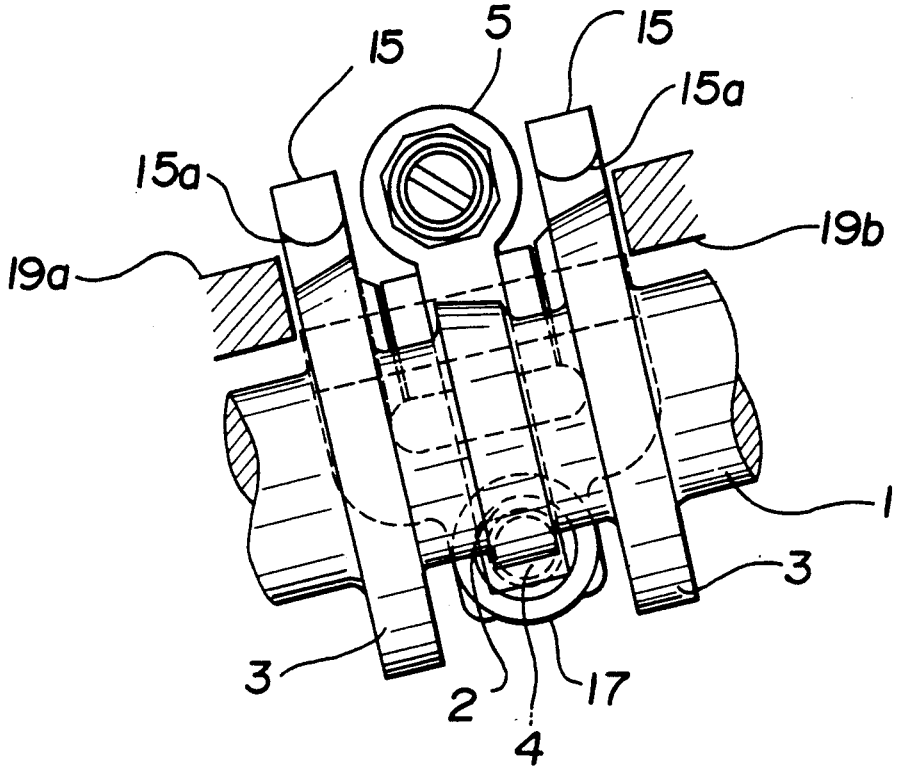
FIG. 2 is a plan view showing the first embodiment of the present invention as applied to a single valve arrangement.

FIGS. 1 and 2 are views of a poppet valve drive train formed in accordance with the first embodiment instant invention. The poppet valve drive mechanism in this arrangement comprises a cam shaft 1 on which a valve opening cams 2 and closure cams 3 are formed integrally. The cam shaft 1 is situated in the vicinity of the upper end of the poppet valve stem 4*a*. The opening cams and closure cams 2 and 3 are engaged by cam followers 5*a* and 15*a* formed on opening rocker arm 5 and the closure rocker arm 15 of the rocker arm assembly 01.

In the first embodiment, for each poppet valve 4, two closure cams 3 and one opening cam 2 is provided. The opening cam 2 is situated between the closure cams 3 on the cam shaft 1.

It will be understood that the poppet valve may be an exhaust valve or it may be an induction valve.

The opening cam 2 engages a cam follower 5*a* formed on the opening rocker arm 5. The moving or "front" end of the opening rocker arm 5 constantly engages the upper end of the valve stem 4*a* of the poppet valve 4.

The anchored or "rear" end of the rocker arm 5 is attached to a clearance adjuster screw 6. The clearance adjuster screw 6 is attached to or has formed at one end thereof, a ball 11. The ball 11 is received in a hemispherical indentation formed in the upper side of a socket member 7, so as to be pivotable in all directions about the central point of the spherical indentation.

Thus, the rocker arm 5 is pivotable about a ball and socket joint defined by ball 11 and the socket member 7 such that according to the rotation of the opening cam 2 the tip of the valve stem 4*a* is pushed downwardly for opening the poppet valve 4.

On the other hand, the closure rocker arm 15 is of a bifurcated configuration and is pivotally connected to the central portion of the opening rocker arm 5 by means of a journal pin 16. At its bifurcated upper end the closure rocker arm 15 is formed integrally with a pair of closure cam followers 15*a* which are in constant engagement with the closure cams 3. The closure rocker arm 15 is thus pivotable, according to the rotation of closure cams 3, with respect to the opening rocker arm 5.

At its other end, which in the first embodiment is not bifurcated, the tip of the closure rocker arm 15 engages the bottom of a valve stem retainer cap 17. The retainer cap member 17 is retained on the tip of the valve stem 4*a* by means of a collet. This engagement urges the valve stem in the upward or closing direction in accordance with the rotation of the closure cam 3 which drives the closure rocker arm 15 to pivot about the journal pin 16 by which it is attached to the opening rocker arm 5.

The closure cam 3 is formed such that it allows the closure rocker arm 15 to move downward at the timing when the poppet valve 4 is to be opened. Conversely, at the timing when the poppet valve 4 is to be closed, the opening cam 2 is formed so as to allow the opening rocker arm to move upwardly so as to avoid interference with the closure of the poppet valve 4.

With the above construction, the poppet valve drive train formed in accordance with the first embodiment does not require a valve closure spring. Instead, at the timing when the valve is to be opened, it is pushed downwardly by the opening cam 2 against an essentially non-existent resistance and thereafter the poppet valve 4 is closed by means of the closure cam 3. Therefore, the degree of resistance of the cam shaft to being moved along its axis during rotation is greatly reduced, thus allowing easy adjustment of the valve timing.

As mentioned above, the opening rocker arm 5 is attached to the ball 11 by means of the clearance adjuster screw 6. A threaded portion 6*a* of the clearance adjuster screw 6 is threaded into a threaded hole formed at the rear end of the opening rocker arm 5. Rotation of the clearance adjuster screw 6 in the inward direction drives the rear end of the opening rocker arm 5 upwards causing it to pivot about the fulcrum formed by the point of engagement between the opening cam 2 and the cam follower 5*a*, such that the front end of the opening rocker arm 5 is moved slightly in the opening direction. Conversely, in a similar manner, when the clearance adjuster screw 6 turned in the opposite direction, the front end of the opening rocker arm is moved to a proportional degree in the closure direction.

On the other hand, since the connection between the closure rocker arm 15 and the opening rocker arm 5 is relatively close to the ball and socket joint defined by the ball 11 and the socket member 7 the contact point between the closure cam follower 15*a* and the closure cams 3 remains relatively unaltered. Thus, the rotation of the clearance adjuster screw 6 serves to adjust the clearance between the front end of the opening rocker arm 5 and the front end of the closure rocker arm 15.

When the desired clearance between the ends of the rocker arms is obtained the locking nut 8 is tightened so as to maintain the clearance adjustment.

As shown in the FIGS. 1, the socket member 7 is received in a blind bore 9*a* defined in the cylinder head 9 and formed with a passage structure which enables lubricating fluid to be constantly supplied to the interface defined between the ball 11 and the concavity.

Figure 3A:
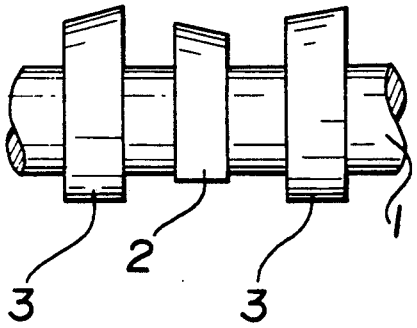
FIGS. 3A and 3B are partial plan views showing compound cam configurations applicable with the various embodiments of rocker arm assemblies according to the present invention.

Referring now to FIG. 3A, the section of the cam shaft 1 on which the compound opening cam 2 and closure cams 3 are formed in accordance with the first embodiment of the invention is shown. The compound cams 2 and 3 according to one embodiment are formed such that their profile changes gradually and continuously along the axis of the cam shaft 1. Therefore gradual movement of the cam shaft 1 along its axis is effective for changing the opening and closing timing and characteristics of the poppet valve 4 along a continuous curve. The cams 2 and 3 are therefore well suited to be operated by a system which constantly monitors the current operating conditions of the engine and adjusts the position of the cam shaft 1 in fine increments to the position exactly suited for the current mode of operation.

For example, the respective profiles of the opening and closure cams 2 and 3 may be such that in accordance with the position of the cam shaft 1 along its axis, the valve opening time and length of the valve stroke may be adjusted to be relatively small while the engine is running at a low speed. On the other hand, when the engine is accelerated the position of the cam shaft 1 may be shifted, along its axis, to a position whereat the profiles of the respective cams 2 and 3 define a longer stroke and opening duration for the poppet valve 4.

In the above manner, when the engine is running at a low speed, valve overlap can be eliminated, and the fuel efficiency is improved while the noxious emmissions of the engine can be decreased. On the other hand, when the engine is being operated at higher speeds the induction and exhaust efficiency can be maximized and the maximum power output of the engine can increased.

Figure 3B:
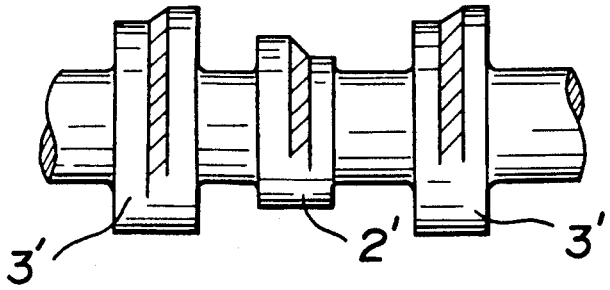

In FIG. 3B an alternative embodiment of the compound closure and opening cams is shown.

The closure cams 3' and opening cam 2' of the alternative embodiment differ from those of the FIG. 3A embodiment in that instead of being formed with the continuous curve which characterizes the opening and closure of cams 2 and 3 of the FIG. 3A embodiment, they are stepped so as to basically provide cam surfaces defining valve timing and stroke length for two basic operation modes between which a compound intermediate section is defined. The intermediate section serves to guide the cam followers between the respective steps of the cams 2' and 3'.

The cam followers 5*a* and 15*a* of the respective rocker arms 5 and 15 are formed with radiused crowns such that, as the stepped cams are driven along the axis of the cam shaft 1 the cam followers can follow the contours of the cams 2' and 3' without becoming hung up on the corners between the step transitions.

Thus, the stepped cams 2' and 3' are well suited for less complex control operations in which the best valve timing is more roughly approximated. The stepped cam configurations also have the advantage of being much easier to manufacture by conventional two axis cam grinding machinery than the cams 2 and 3 of the FIG. 3A embodiment.

In the first embodiment, a pair of guides 19*b* and 19*a* are formed at either side of the bifurcated portion of the closure rocker arm 15. The guides 19*a* and 19*b* engage the outer side surfaces of the rocker arm 15 so as to prevent them from tilting or swaying from side to side. Since the closure rocker arms 15 are thus restricted, they can only pivot along horizontal axes parallel to the axis of the cam shaft, and, since the opening rocker arm 5 is pivotally mounted on the closure rocker arm 15 by way of journal pin 16, it too is restricted to pivot about axes running parallel to the cam shaft 1 and intersecting the central point of the ball 11. The tendency for the cam followers to be driven sideways by the cam surfaces when the cam shaft 1 is driven along its axis in order to adjust the valve stroke and timing is therefore eliminated.

Figure 4A:
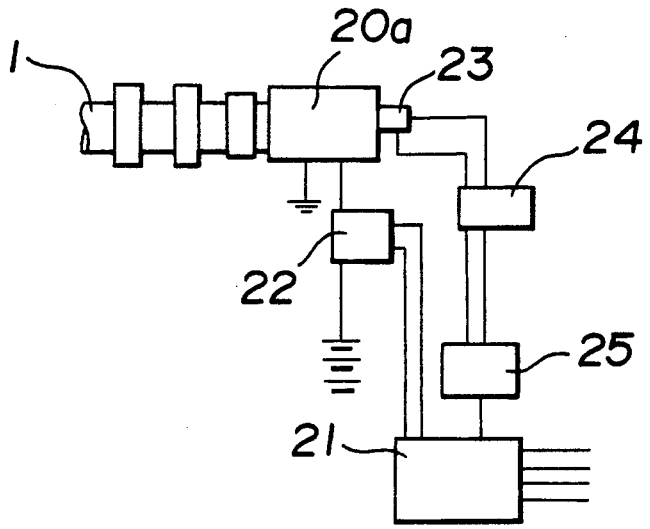
FIGS. 4A and 4B are schematic depictions of a control arrangement for driving the cam shaft comprising the compound cam.
Figure 4B:
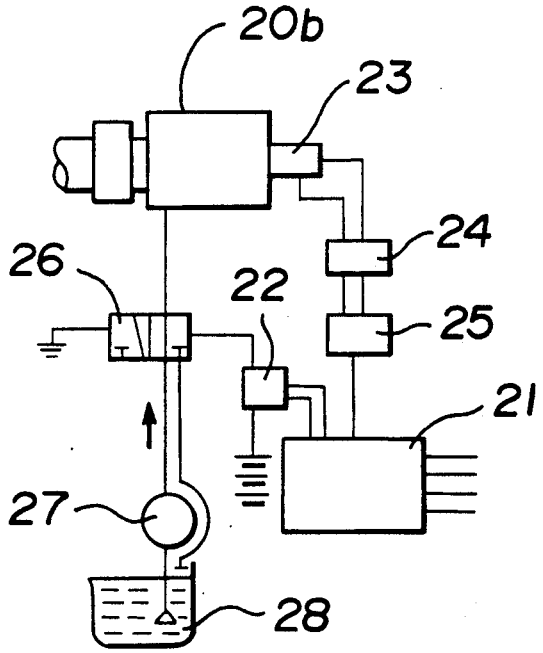

In FIG. 4A and 4B control mechanisms for driving the cam shaft 1 along its axis in order to adjust the valve timing are depicted schematically.

The control mechanism depicted in FIG. 4A comprises an electro-magnetic actuator mechanism 20*a* for driving the cam shaft along its axis.

The central processor unit 21 receives various signals indicative of the current driving condition of the engine such as engine speed, engine temperature engine load, accelerator position etc. and calculates therefrom a target value indicative of the appropriate cam shaft position. The central processor unit 21 then compares the target position with the current position and outputs a control signal with the appropriate cam shaft position adjustment value to the driving circuit 22.

The driving circuit 22 is responsive to the control signal for outputting a driving pulse of a proportional value to the electro-magnetic actuator mechanism 20*a*.

The electro-magnetic actuator mechanism 20*a* is energized to drive the cam shaft 1 along its axis in the direction and magnitude determined by the driving pulse output from the from the driver circuit 22.

A stroke detector 23 is provided in connection with a portion of the cam shaft 1 for detecting the magnitude of change in the longitudinal position of the cam shaft 1. The stroke detector 23 outputs a signal indicative of the changes in longitudinal position of the cam shaft 1 to the signal convertor circuit 24.

The signal convertor circuit 24 is operable to output an appropriate signal indicative of the magnitude of change in the cam shaft position to the position discrimination circuit 25 which adds the change data to its currently stored position data so as to arithmetically determine the current position of the cam shaft 1 and to provide a signal to the controller 21 for updating the position data in the central processor unit 21. The central processor unit 21 then compares the updated position data from the discrimination circuit to the current target value so as to determine whether to make further adjustments in the position of the cam shaft 1.

In the above manner the control circuit according to the embodiment depicted in FIG. 4A, the elements 21 through 25 define a control feedback loop for controlling the cam shaft positioning operations of the electromagnetic actuator 20*b*.

The control mechanism according to the embodiment depicted in FIG. 4B, is essentially similar to that depicted in FIG. 4A with the exception that the driver signal output of the driver circuit 22 is supplied to drive a hydraulic relay valve 26, and in that the drive shaft actuator mechanism 20b is hydraulically energized by means of the hydraulic output from the hydraulic relay valve 26.

The control circuit elements 21 through 25 of the embodiment depicted in FIG. 4B are otherwise identical to those 21 through 25 depicted in FIG. 4A therefore a detailed description will be omitted for the sake of brevity.

The hydraulic relay valve 26 is connected at its input side to a hydraulic pressure source 27 which draws hydraulic fluid from a reservoir 28. In response to the signal from the driver circuit 22, the valve 26 is energized to open to a magnitude and/or for a duration indicated by the control signal output from the central processor unit 21 so as to hydraulically energize the hydraulic cam shaft actuator 20b to move the cam shaft 1 to the desired position. Thereafter the control feedback loop defined by the elements 21 through 25 carry out control operations essentially identical to those described above in connection with the FIG. 4A control circuit embodiment.

Accordingly, it will be appreciated from the above dissertation that since the closure spring provided in the conventional poppet valve closure mechanism is dispensed with in favor of the closure cam reducing the friction between the cam followers and the cam surface. For this reason the resistance to linear motion of the cam shaft is greatly reduced. This reduction in friction allows the cam shaft to be driven smoothly and quickly along its axis by the control mechanism defined by the control elements 20a (or 20b) through 25 (or 26) for altering the valve opening/lift characteristics to accord with the current driving conditions with a minimum of motive force. This allows quick and precise control over the valve timing and stroke characteristics without the need of providing an unduly heavy drive mechanism.

Figure 5:
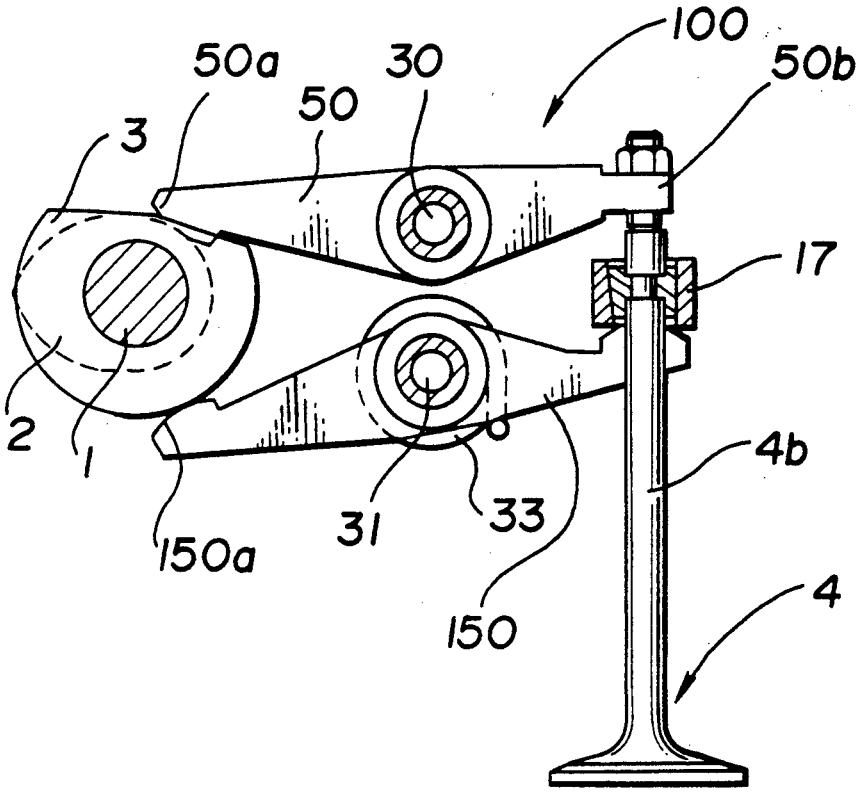
FIG. 5 is a side elevation view of a second embodiment of a rocker arm assembly according to the present invention.
Figure 6:
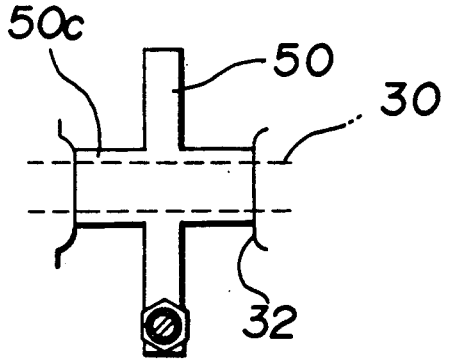
FIG. 6 is a plan view showing a rocker shaft journal arrangement for rocker arm assembly according to the second embodiment.

In the second embodiment of the instant invention depicted in FIGS. 5 and 6, the rocker arm assembly 100 opening rocker arm 50, and the closure rocker arm 150 are formed so as to be pivotably mounted independently of each other.

The closure and opening cams 2 and 3 of the second embodiment are compound type cams.

The opening rocker arm 50 is pivotally mounted by means of a journal pin 30 and the closure rocker arm 150 is pivotally mounted by means of a journal pin 31. The axis defined by the journal pin 31 is parallel to the axis defined by the journal pin 30. The pins 30, 31 are supported at their ends in suitably bores formed in support bosses 32 formed in the cylinder head or associated structure.

As were the opening and closure rocker arms 5 and 15 of the first embodiment, the opening and closure rocker arms according to the second embodiment are formed with cam followers 50a and 150a. As in the case of the first embodiment, the opening cam follower 50a is maintained in constant engagement with the opening cam 2 and the closure cam follower 150a is maintained in constant engagement with the closure cam 3.

The opening cam 2 is operable for pushing the rear end of the rocker end upwardly so that the opening rocker arm pivots about the pin 30 so as to cause the front end of the opening rocker arm to push the end of the valve stem 4a downwards so as to open the poppet valve 4.

Conversely, as in the first embodiment, the closure cam 3 is operable for pushing the rear end of the rocker end upwardly so that the closure rocker arm pivots about the pin 30 so as to cause the front end of the closure rocker arm to push upwardly against the valve stem retainer cap 17 retained on the end of the valve stem 4a so as to close the poppet valve 4.

The front end of the opening rocker arm 50a is provided with a clearance adjuster screw 50b for adjusting the valve seating clearance.

The closure rocker arm 150 is engaged by a light closure spring 33. The closure spring 33 applies a light bias on the closure rocker arm 150 for urging it to rotate about the journal pin 31 in the closing direction. This light bias serves to prevent the closure rocker arm 150 from bouncing see-saw fashion between the bottom of the valve stem retainer cap and the surface of closure cam 3.

Although in this embodiment the small closure spring 31 is provided, the force it exerts on the closure rocker arm 150 is very light and is insufficient to close the valve properly by itself when the engine is running at any significant speed. Thus, since the closure force of the closure spring 33 is small the frictional resistance it creates with respect to the shifting operation of the cam shaft 1 along its axis, is insignificant.

In FIG. 6 the journal members for the closure rocker arm 50 are shown in plan view. As will be appreciated from FIG. 6, the rocker arm 50 comprises a long boss portion 50c extending from the side faces thereof. The boss portion 50c serves to extend the length of the bore through which the journal pin 30 is inserted so that any significant degree of lateral movement or sway of the closure rocker arm 50 is impossible. Further, the boss portion 50c is dimensioned such that the ends thereof engage the stationary centering guide surfaces 32 formed at either side of the boss portion 50a so as to prevent the opening rocker arm 50 from moving along the axis of the journal pin 30. Thus, in a case where the cam shaft 1 on which the compound cams 2 and 3 or the stepped compound cams 2' and 3' are formed, is employed and is shifted along its axis so as to alter the cam profile and valve timing, the opening rocker arm 50 exhibits no tendency to sway or be pushed sideways along its pivoting axis. Therefore the valve timing and or stroke can be precisely adjusted according to the position of the cam shaft. It will be noted that this precision is particularly important for the non-stepped compound cams 2 and 3 since the timing adjustments may be made in minute increments.

Figure 7:
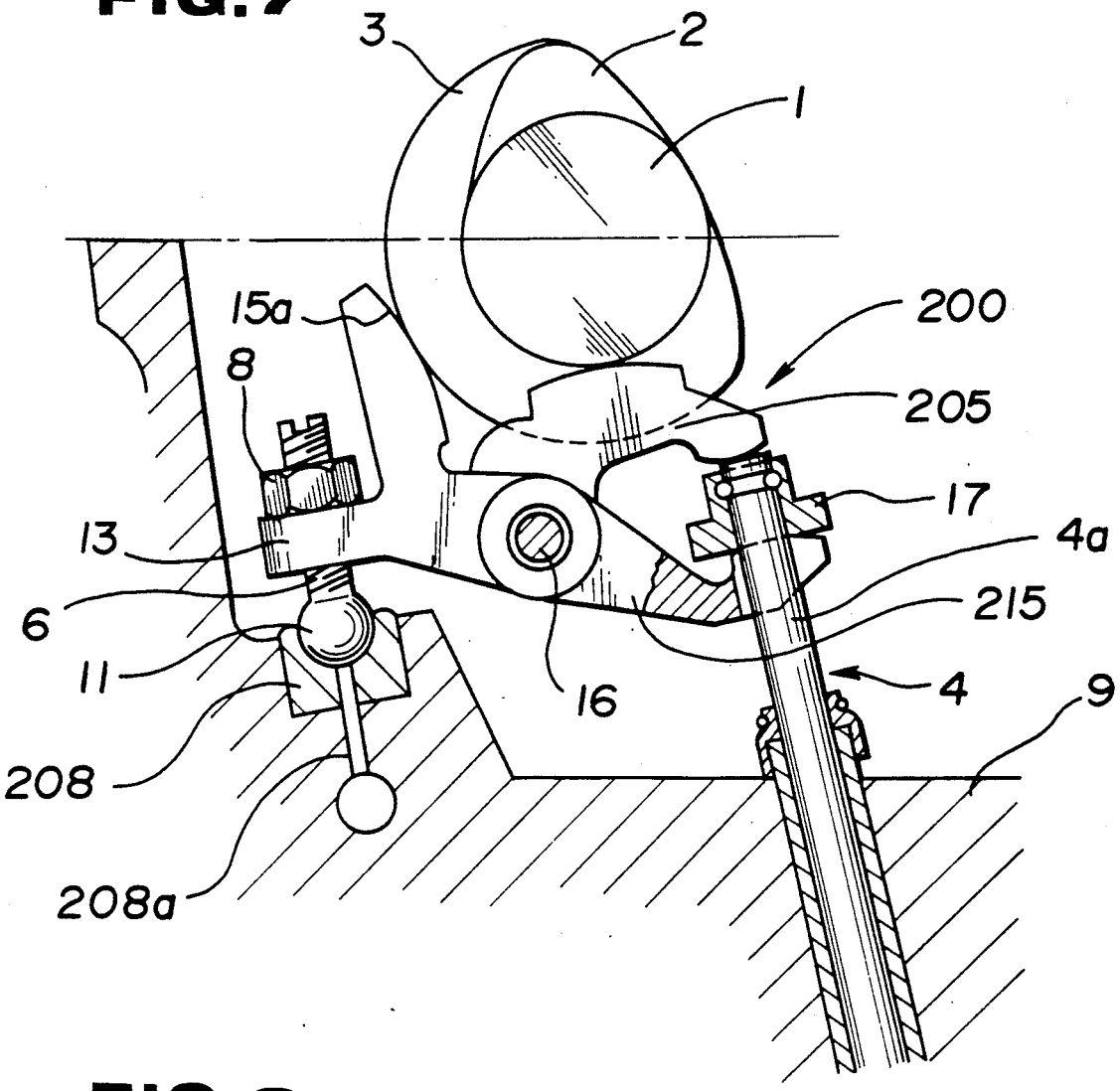
FIG. 7 is a side elevation, partially in section showing a third embodiment of a rocker arm assembly according to the present invention.
Figure 8:
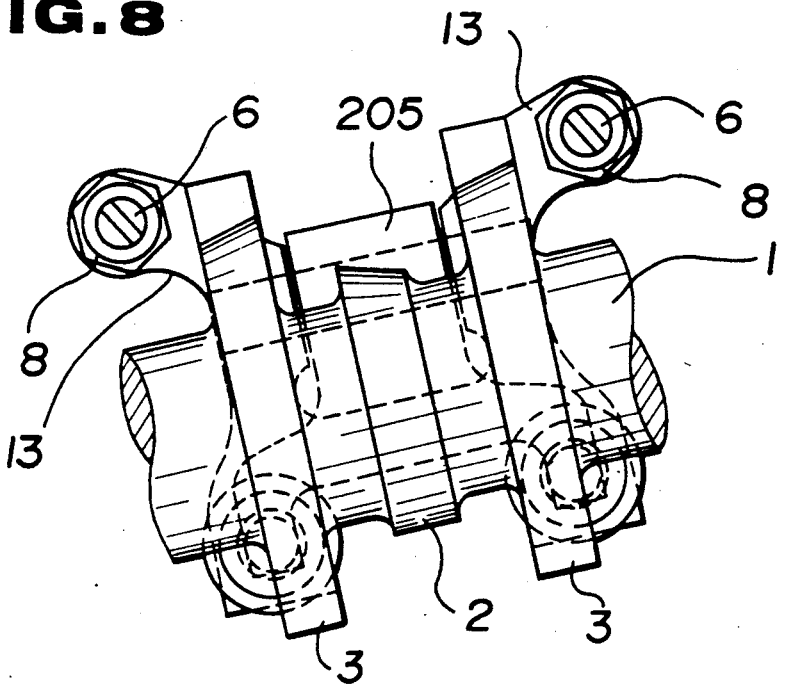
FIG. 8 is a plan view showing a third rocker arm assembly embodiment.

The rocker arm assembly 200 according to the third embodiment depicted in FIGS. 7, and 8 is in most respects similar to that of the first embodiment of the invention depicted in FIGS. 1 and 2. Therefore, a detailed explanation of the operation of the rocker arm assembly 200 will be omitted for the sake of brevity as it will be understood that the elements having like numerals have similar functioning characteristics to the like numbered elements in the first embodiment.

As will be appreciated best from FIG. 8, the major difference between the rocker arm assembly 200 of the third embodiment and that of the first embodiment, comes in that, instead of the single ball pivot 11, a pair of ball pivots are provided on the closure rocker arm 215 in the third embodiment at the ends of a pair of clearance adjuster screws 6.

It will also be noted from FIG. 8, that the third embodiment of a rocker arm assembly also differs from the first embodiment in that, where the rocker arm assembly of the first embodiment is associated with a single poppet valve 4, the rocker arm assembly according to the third embodiment is associated with a pair of poppet valves 4. The closure and the opening rocker arms 205 and 215 comprise pairs of engaging portions 15*a* and 5*a* for engaging the valve stems 4*a* and the retainer cap members 17 of the pair of poppet valves 4. As will be readily understood by those skilled in the art, the pair of poppet valves 4 are driven in unison by the closure and opening cams 2 and 3 and the rocker arms 205 and 215 in a manner which is essentially identical to that in which the single poppet valve of the first embodiment is driven.

A third difference between the third embodiment of the rocker arm assembly and the first embodiment is most readily apparent from FIG. 7. In this figure it can be seen that, whereas in the first embodiment of the rocker arm assembly the opening rocker arm 5 is adapted to be pivotally coupled to the cylinder head 9 and the closure rocker arm 15 is pivotally mounted at the mid-section of the opening rocker arm 5, in the third embodiment the closure rocker arm 215 is adapted to be pivotally coupled to the cylinder head 9 and the opening rocker arm 205 is pivotally mounted by means of the journal pin 16 at the mid-section of the closure rocker arm 215.

With this arrangement, the front ends of the rocker arms 205 and 215 are driven to move in a manner essentially identically to that of the rocker arms 5 and 15 of the first embodiment in response to the rotation of the opening and closure cams 2 and 3.

An advantage of the arrangement wherein the opening rocker arm 205 is pivotally mounted at the mid-section of the closure rocker arm 215 is that the length of the opening rocker 205 is approximately half that of the opening rocker arm 5. This has the result of advantageously reducing the weight of the rocker arm assembly.

The ball pivots 11 are received in a pair of hemispherical socket members 208 which are mounted in the cylinder head 9 and arranged so as to define an axis running parallel to the axis of the cam shaft 1. Lubricant passages 208*a* are formed in connection with the hemispherical socket members 208 for supplying lubricant to the interface between the balls 11 and the hemispherical sockets 208.

The balls 11 of the adjuster screws 6 are pivotably received in the hemispherical socket members 208 and the threaded portions of the adjuster screws 6 are received in threaded holes at the rear end of the rocker arm 215. Lock nuts 8 are provided for maintaining the screws 6 in position on the closure rocker arm 215.

Since the closure rocker arm 215 is pivotally mounted on the cylinder head 9 by ball and socket joints defined at two points on the cylinder head 9 the rocker arm is restricted from pivoting on any other axis other than that which passes through the two ball and socket joints.

It will be noted that in this arrangement maximum advantage is taken of the spread between the closure cam followers 15*a* such that the clearance adjuster screws 6 are threaded into mounting flanges 13 formed on the outer sides of the closure rocker arm 215 in the vicinity of the cam followers 15. In this manner a wide mounting base is defined between the ball ends 11 of the clearance adjuster screws 6 and economical use, in terms of the weight of the rocker arm assembly, is made of the inherently wide configuration of the rocker arm having the double cam followers.

Still another advantage obtained by providing the adjuster screws 13 on the flanges 13 projecting from the side faces of the rocker arm 215 is that the overall rocker arm assembly can be made more compact by moving the socket members relatively close to the cam shaft 1 while still allowing tool access to the lock nut 8 and adjusting screw 6.

Thus, lateral sway and/or tilting of the rocker arm assembly according to the invention can be completely eliminated and the positions of the cam followers 15*a* and 5*a* on the compound cams can be precisely adjusted and maintained as the cam shaft 1 is driven along its axis during the valve timing and or stroke adjustment operations.

Figure 9:
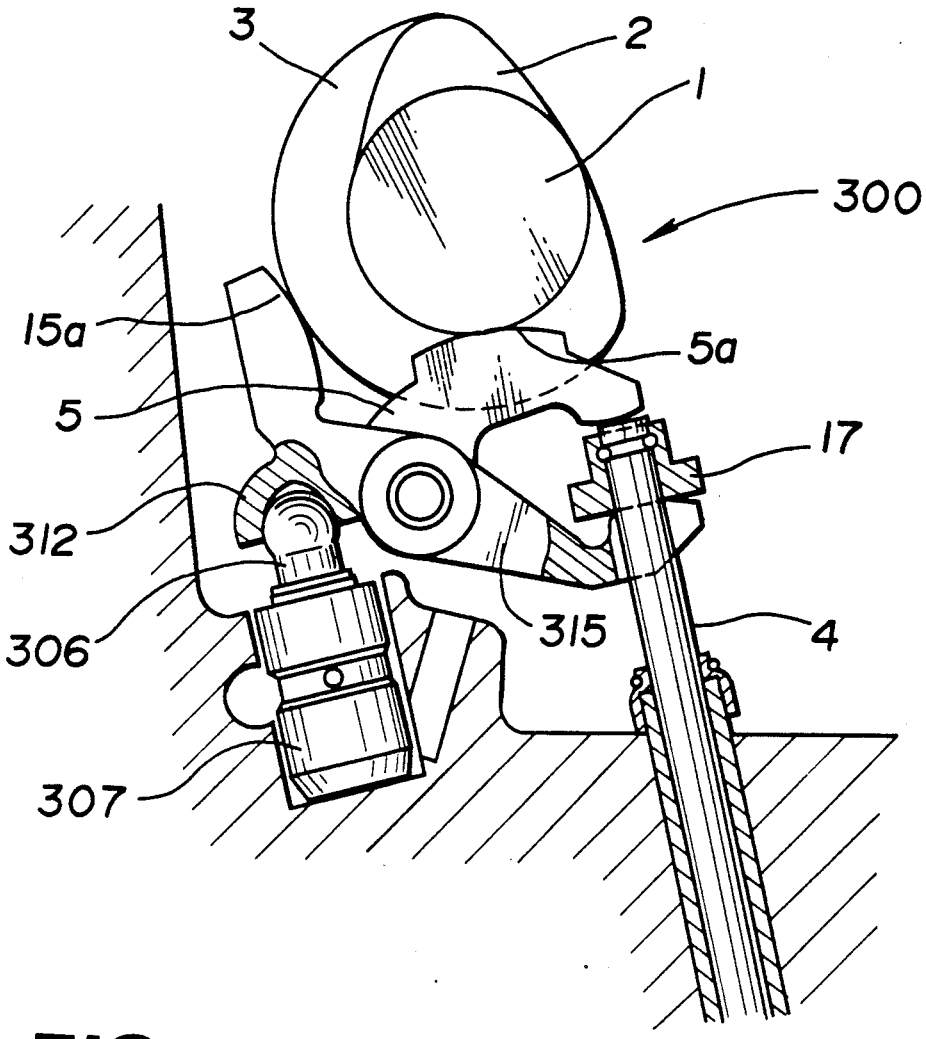
FIGS. 9–10 show a fourth embodiment of a rocker arm assembly according to the present invention.
Figure 10:
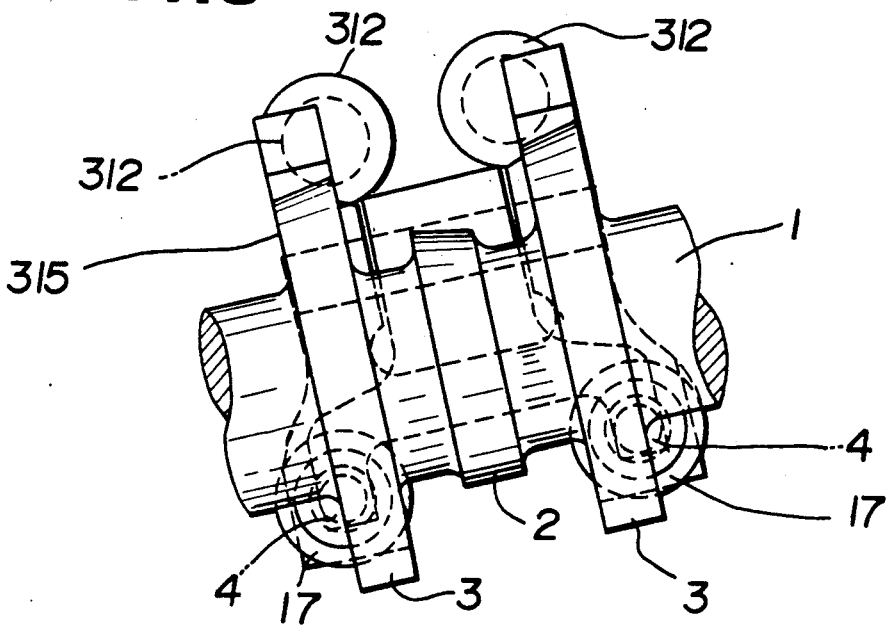

In FIGS. 9 and 10 a fourth embodiment of a rocker arm assembly according to the invention is depicted. The rocker arm assembly 300 in this embodiment is essentially identical to that of the third embodiment in all respects with exception of the construction of the ball and socket joints which define the pivotal connection between the closure rocker arm 315 and the cylinder head 9, and in the spacing between the ball and socket joints.

In this arrangement the balls 11 formed on the clearance adjuster screws 6 and the socket members 7 are replaced with hydraulic lash adjuster mechanisms. In this instance the rear end 312 of the closure rocker arm 315 is formed with a pair of spherical concavities which receive pivot balls 306 which are provided at the tops of the lash adjusters 307.

The lash adjusters 307 are received in the blind bores 9*a* in the cylinder head and are constantly provided with lubricant fluid which is fed thereto under a predetermined hydraulic pressure. Accordingly, the pivot balls at the tops of the lash adjusters tend to be continuously urged upwardly with a controlled amount of force.

Under the influence of the lash adjusters 307, the cam followers 5*a*, 15*a* are biased into engagement with their respective cams and therefore produce reactions which tend to close the scissor like arrangement and thus move the valve stem engaging portions 5*b*, 15*b* of the rocker arms 205, and 315 toward each other. This of course tends to reduce the clearances between the valve stem 4*a*, and valve stem retainer caps 17 and the respective rocker arms 205, and 315 to zero. Due to the compensating nature of the lash adjusters 307, it is possible to automatically maintain essentially zero clearances under all modes of engine operation even after wear has occurred on the cams 2 and 3 and cam followers 5*a* and 15*a* and engaging surfaces of the rocker arms and valve stem.

Thus, as in the third embodiment, lateral sway and or tilting of the rocker arm assembly 300 can be completely eliminated by providing a pair of ball pivots and the positions of the cam followers 15*a* and 5*a* on the compound cams can be precisely adjusted and maintained as the cam shaft 1 is driven along its axis during the valve timing and or stroke adjustment operations without the disrupting influence of lateral sway. What is more, the cam clearances can be constantly maintained so as to greatly reduce noise, vibration and wear of the valve train.

It will be obvious to those skilled in the art that although the double ball pivot arrangement of the third and fourth embodiments is set fourth above in connection with rocker arm arrangements arranged to drive a pair of poppet valves it is equally applicable in rocker arm arrangements intended to operate any desired number of poppet valves.

Also it will be understood that, although in the embodiments disclosed so far a single opening cam and a pair of closure cams have been associated with each of the rocker arm assemblies, other arrangements are readily conceivable in which the number of opening and closure cams is different, such as for example two opening cams and one closure cam or two opening cams and two closure cams.

Figure 11:
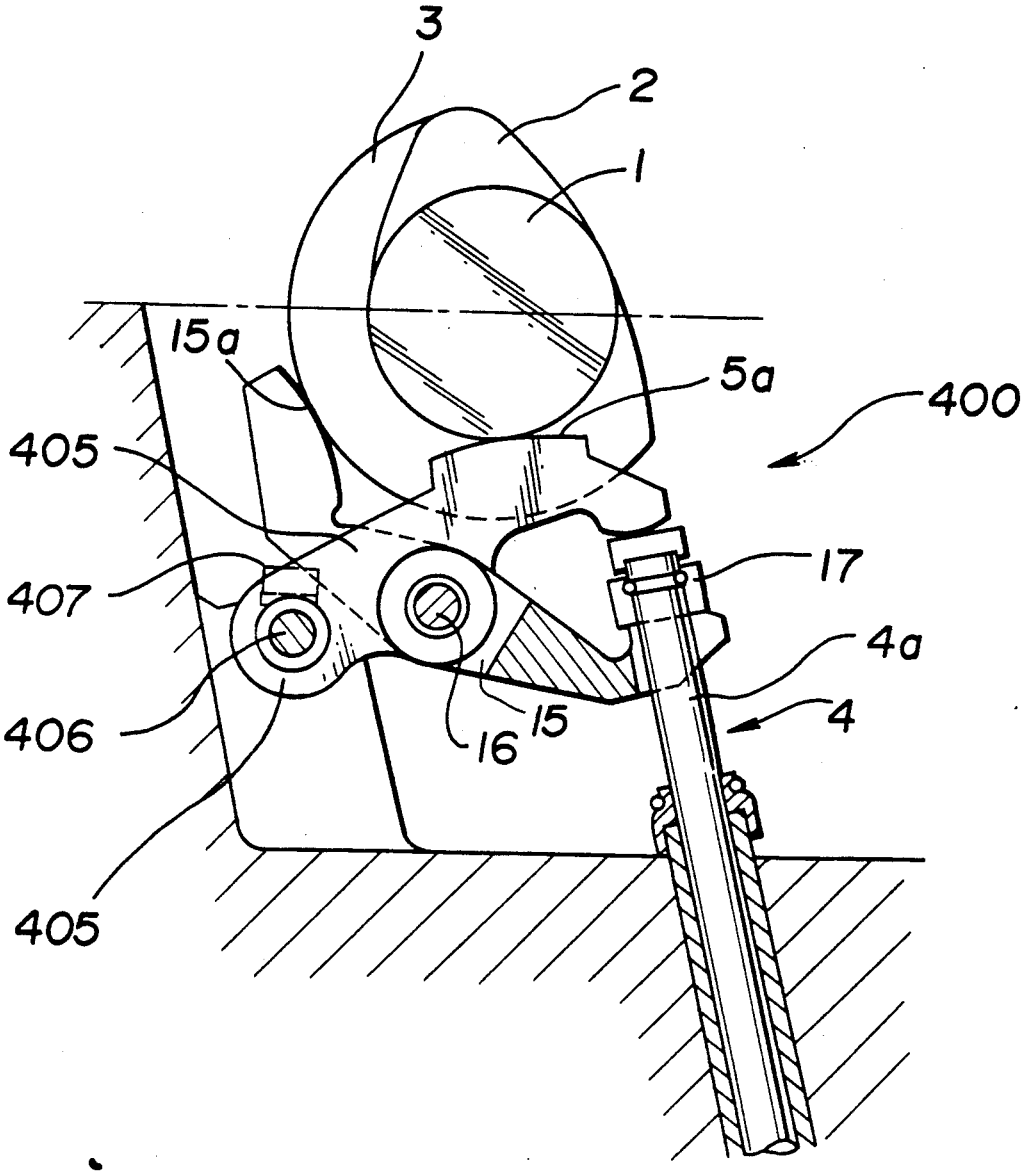
FIGS. 11–12 show a fifth embodiment of a rocker arm assembly according to the present invention.
Figure 12:
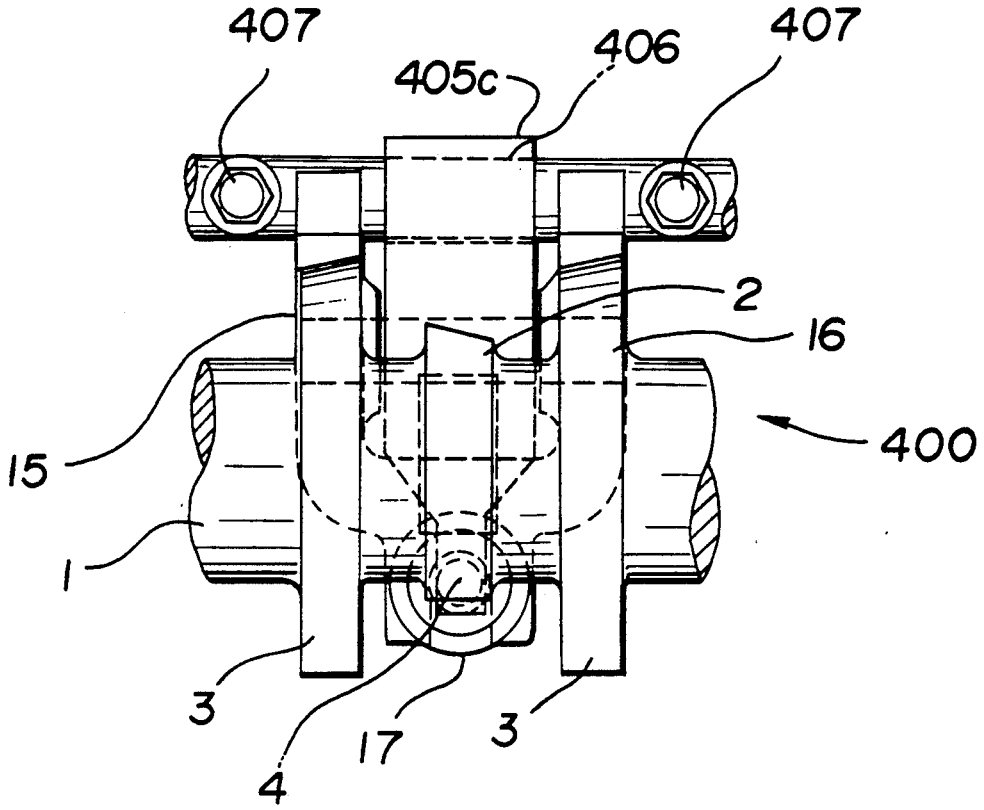

The fifth embodiment of the rocker arm assembly 400 according to the invention depicted in FIGS. 11 and 12 with the exception of the pivot connection between the opening rocker arm 405 and the cylinder head 9 is identical to the rocker arm assembly of the first embodiment.

In this instance also the details of the valve opening and closing operation will be ommitted as it will be understood that the valve opening and closing operations of the rocker arm assembly according to the third embodiment is essentially the same as those of the first embodiment.

In the fifth embodiment, the opening rocker arm 405 is pivotally mounted on the cylinder head 9 by means of a rocker shaft 406. As shown the rocker shaft 406 is arranged to pass through the rear end portion 405*c* of the opening rocker arm 405.

The rocker shaft 406 is connected to the cylinder head 9 by means of retainer bolts 407.

The closure rocker arm 15, as in the previous embodiments, has a bifurcated tip on which a bifurcated valve stem engaging portion 15*c* is formed for engaging the lower side of the valve stem cap 17 for urging the valve stem to close, and the closure cam followers 15*a* are formed on the parallel projecting side portions 12 at its other end for urging the rocker arm 15 into the closure position. The opening rocker arm 405 is disposed between the parallel side portions of the closure rocker arm 15 and supports the closure rocker arm 15 by means of the journal pin 16.

Because the opening rocker arm 405 is pivotally mounted on the cylinder head 9 by means of the rocker shaft 406, lateral sway as well as tilting of the rocker arm assembly 400 out of the vertical plane is prevented. Thus, as before, the valve opening and closing operations can be carried out precisely and without undue vibration.

A further advantage of the pivoting arrangement according to the fifth embodiment is that a single rocker shaft 406 extending along the top of the cylinder head can be used to accommodate all of the rocker assemblies in the drive train. This makes construction of the valve drive train simpler and less costly.

Figure 13:
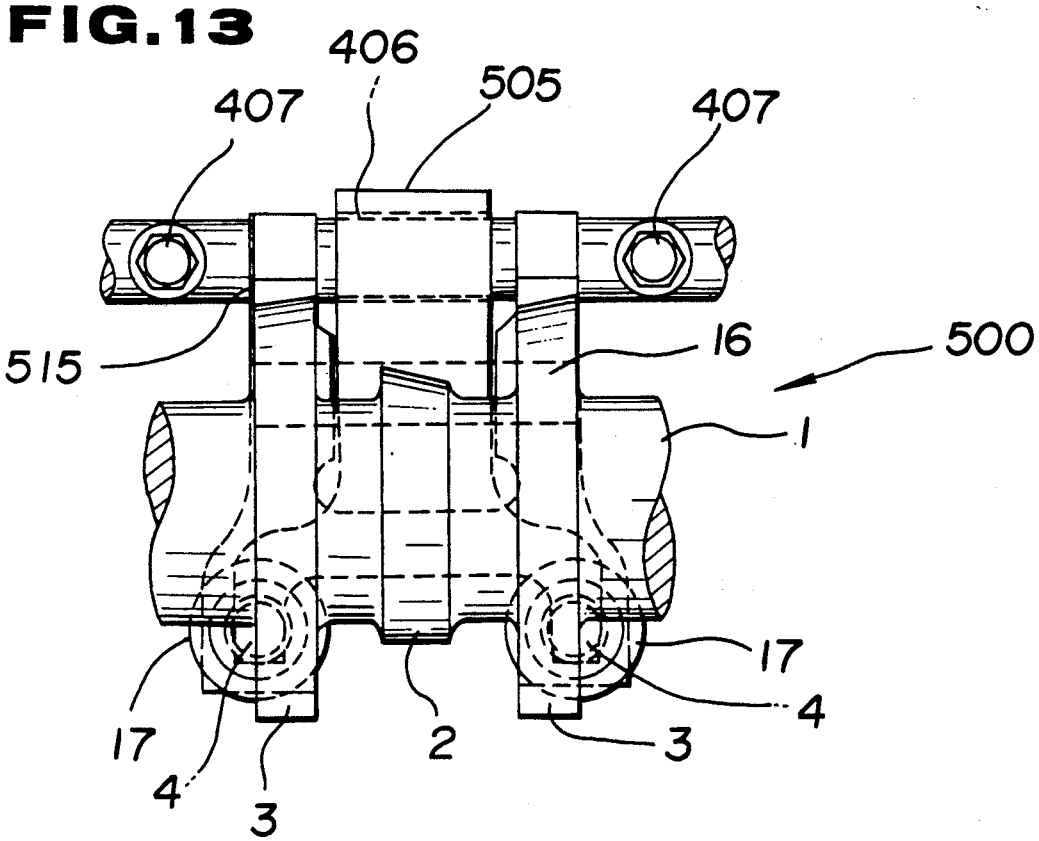
FIG. 13 is a plan view showing a sixth rocker arm assembly embodiment.

In FIG. 13 a sixth embodiment of a rocker arm assembly 500 is depicted. The rocker arm assembly 500 of the sixth embodiment is essentially the same as that of the fifth one but that whereas the rocker arm assembly 400 is associated with a single poppet valve 4, the opening rocker arm 505 and the closure rocker arm 515 each comprise a pair of valve stem engaging portions so as to engage a pair of poppet valves 4.

Figure 14:
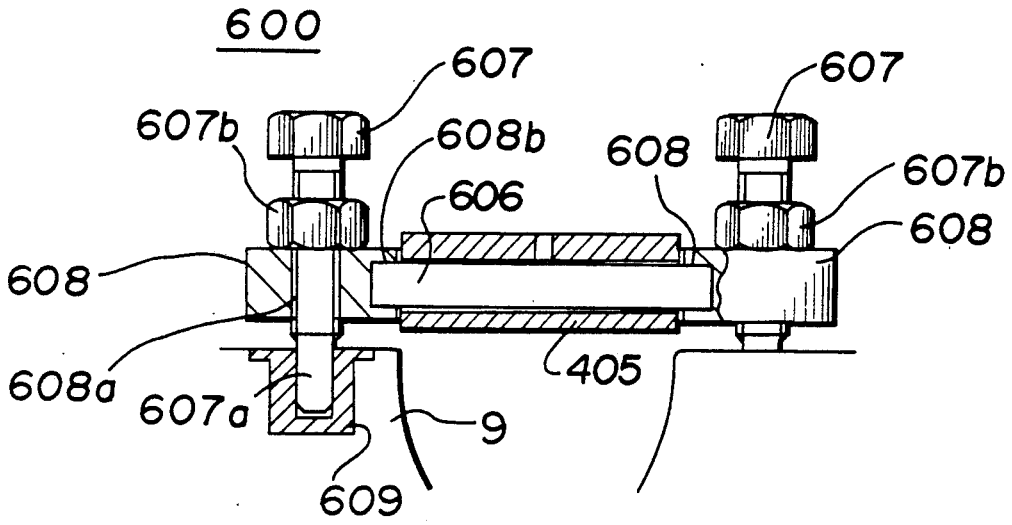
FIG. 14 is a side elevation, partially in section showing an alternative rocker shaft arrangement for the sixth embodiment of a rocker arm assembly according to the present invention.

In FIG. 14 an alternative rocker shaft arrangement is depicted wherein the single rocker shaft 406 common to a plurality of rocker arm assemblies mentioned above, is replaced by a rocker shaft 606 which is suited to accommodating a single rocker arm assembly such as those denoted by 400 or 500 in FIGS. 12 and 13.

As can be seen from FIG. 14, which is a cross-sectional view taken along the axis of the rocker shaft 606, the mounting assembly for the rocker shaft 606 comprises a pair of adjustable end mount members 608. The adjustable end mount members 608 have threaded bores 608*a* passing through the centers thereof into which valve clearance adjuster screws 608 are threaded.

The lower ends of the clearance adjuster screws 607*a* comprise non-threaded mounting stud portions 607*a*. The stud portions 607*a* are rotatably received in mounting sleeves 609 provided on the cylinder head 9.

On the mutually facing sides of the pair of mounting members 608 rocker shaft, mounting bores 608*b* are formed. The ends of the rocker shaft 606 are inserted into these bores so that the rocker shaft extends between the mounting members 608. The rocker shaft is made to pass through the boss at the rear end of the rocker arm 405 and the spacing between the mutually facing sides of the mounting members is selected to be essentially equal to the width of the rocker arm 405 so that no end play of the rocker arm 405 on the rocker shaft 606 is permitted.

After loosening the lock nut 607*b* the height of the mounting members 608 relative to the cylinder head is adjustable by rotating the clearance adjuster screws 607. In this manner the cam clearance can be adjusted whereafter the lock nut 608*b* is retightened so as to maintain the setting.

Figure 15:
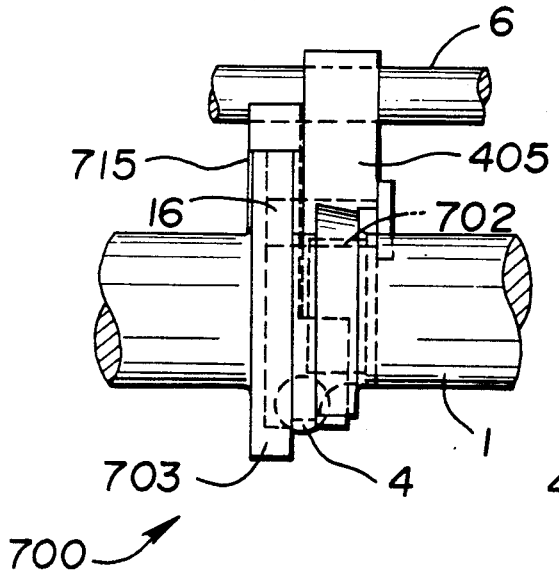
FIG. 15 is a plan view showing a seventh rocker arm assembly embodiment.
Figure 16:
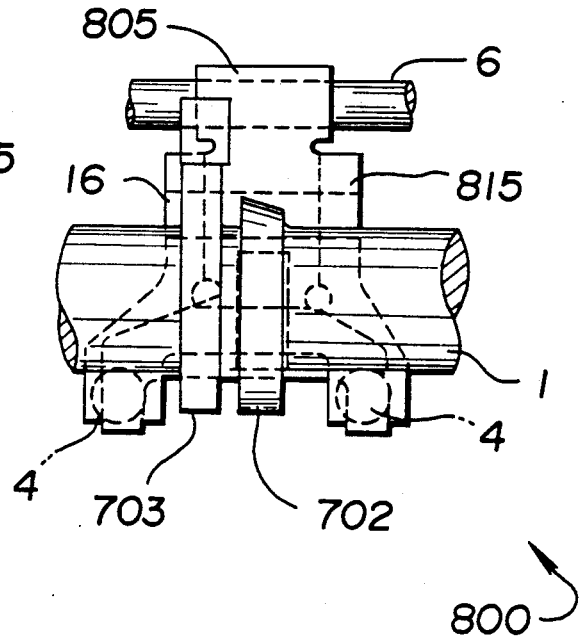
FIG. 16 is a plan view showing a eighth rocker arm assembly embodiment.
Figure 17:
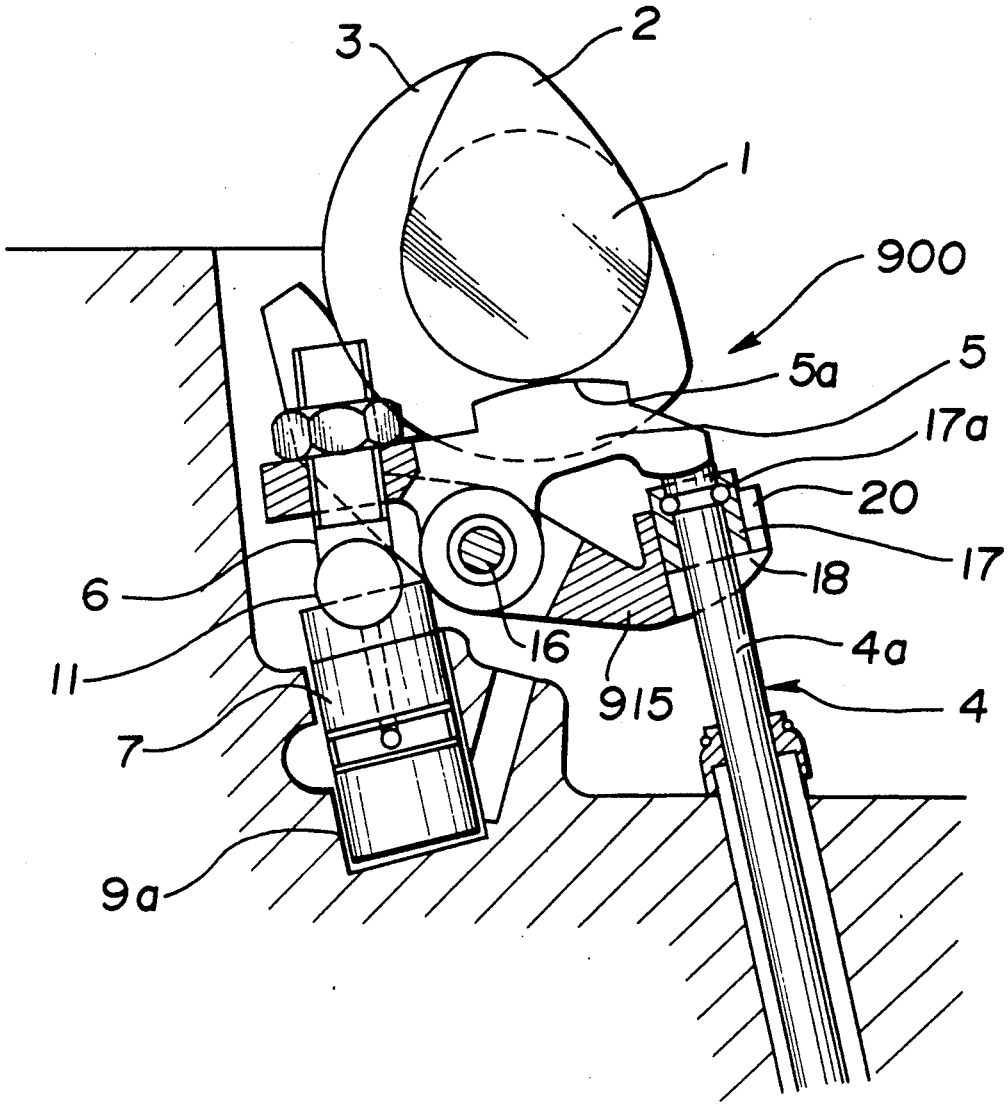
FIGS. 17 and 18 are views showing a ninth embodiment of a rocker arm assembly according to the present invention.
Figure 18:
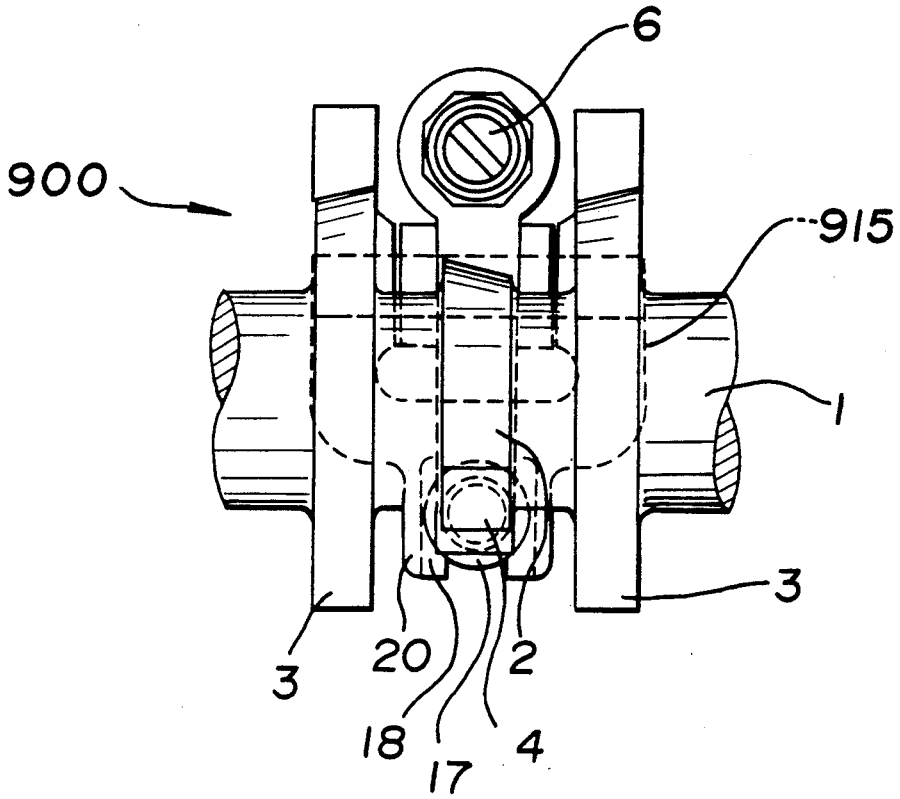
Figure 19:
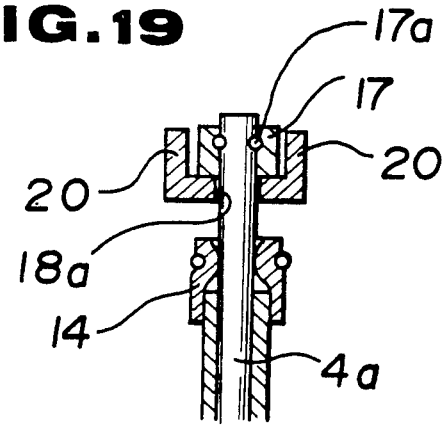
FIGS. 19 and 20 are enlarged views showing details of the valve stem engaging portion of the closure arm of the ninth embodiment of the present invention.
Figure 20:
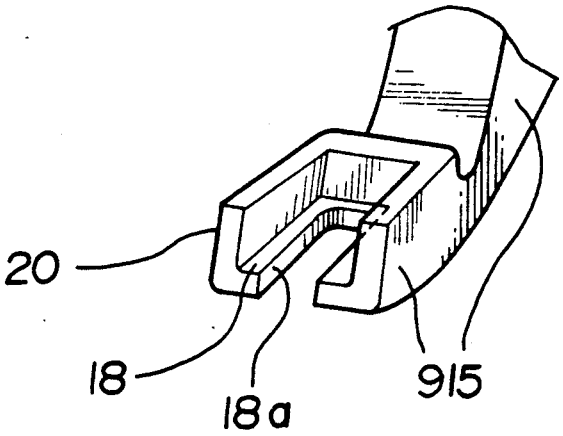

In FIGS. 15 and 16 alternative embodiments of the rocker arm assembly according to the invention are depicted in plan view. The seventh embodiment of the rocker arm assembly 700 shown in FIG. 15, is in all respects similar to that of the fifth embodiment (400) except for the fact that, whereas the rocker arm assembly 400 comprises a pair of side portions on which the two closure cam followers 15*a* are formed, the closure rocker arm 715 comprises a single arm and a single cam follower 15*a*.

Similarly, in the eighth embodiment of the rocker arm assembly 800 shown in FIG. 16, the rocker arm assembly is in all respects similar to that 500 of the sixth embodiment except for the fact that again, where the rocker arm assembly 500 comprised a pair of side portions on which the two closure cam followers 15*a* are formed, the closure rocker 815 comprises a single arm and a single cam follower.

In FIGS. 17 through 20 a ninth embodiment of the rocker arm is invention shown. The ninth embodiment of the rocker arm assembly is essentially the same as the rocker arm assembly 01 of the first embodiment other than the configuration of tip portion of the closure rocker arm 915 which features a slotted bucket-like construction of the nature shown in FIG. 20.

In the rocker arm assembly 900, attention is given to the problem of reducing the length of the valve stem. For this purpose the end of the closure rocker arm 915 which engages the valve stem retainer cap 17 is formed with a pair of parallel side walls or flanges 20 projecting upwardly from a bottom web 18. A slot 18*a* is formed in the bottom web 18 through which the valve stem 4*a* is passed. The gap between the parallel flanges 20 is made just wide enough to accommodate the valve stem retainer cap 17 which is retained on the valve stem 4*a* by means of a collet 17*a*. The top face of the bottom web 18 engages the bottom of the valve stem retainer cap 17 for urging the valve 4 to close.

With this arrangement the bottom web portion 18 of the tip of the closure rocker arm 915 is stiffened in the vertical directions by the parallel side flanges 20. Therefore, the bottom web portion 18 can be made relatively thin without the danger of becoming too weak or too flexible to stand up to the strain of urging the valve 4 to close at high engine speeds.

By making the lower web portion 18 thin in the above manner, it is possible to reduce the clearance necessary between the bottom of the valve stem retainer cap 17 and the top of the valve stem oil seal 14 provided for preventing lubricant from leaking into the induction or exhaust manifolds. Thus, it is possible to reduce the length of the portion of the valve stem 4*a* protruding from the top of the valve stem sleeve 4*b* provided on the cylinder head 9 the overall length of the valve stem 4*a*.

As will be appreciated to those skilled in the art, by reducing the length of the portion of the valve stem the lateral stresses on the valve stem 4*a* at the point at which it enters the valve stem sleeve 4*b* can be reduced and it may be assured that the valve stem 4*a* moves only vertically and lateral play or flex in the valve stem 4*a* is minimized.

As will also be appreciated by those skilled in the art, with the above configuration not only is it possible to shorten the valve stem 4*a*, it is also possible to reduce the overall size of the engine since the cam shaft can be moved closer to the top of the cylinder head and the valve cover (not shown) can be made smaller. What is more, since the tip of the rocker arm 915 is hollowed out and the valve stem 4*a* is shortened, a further advantage is realized in that the weight of the rocker arm assembly as well as the valve 4 is reduced helping the rocker arm assembly to operate smoothly and reducing the dynamic forces on the cams 2 and 3 and the cam followers 15*a* and 5*a* at high engine speeds.

Figure 21:
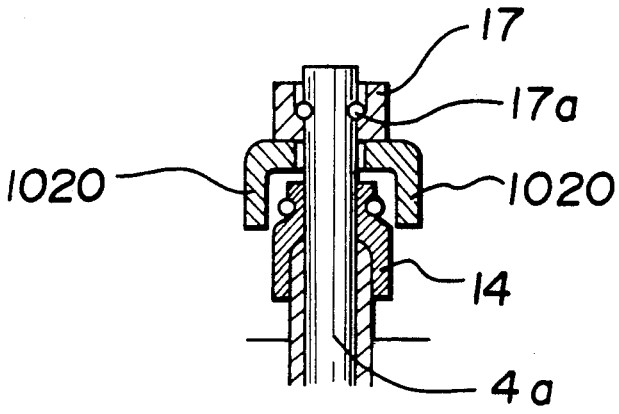
FIGS. 21 and 22 are enlarged views showing details of the valve stem engaging portion of the closure arm of the tenth embodiment of the present invention.
Figure 22:
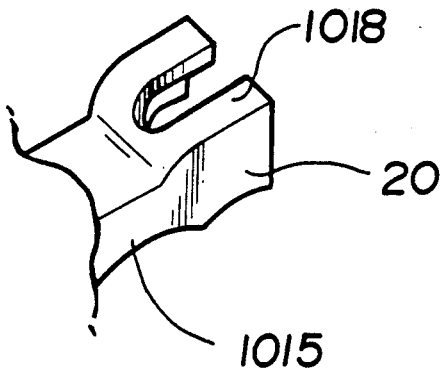

In FIGS. 21 and 22 the tip portion of a closure rocker arm 1015 of a tenth embodiment of a rocker arm assembly according to the invention is depicted. The tenth embodiment rocker arm assembly is similar to the rocker arm assembly 900 with the exception that the tip of the closure cam which engages the valve stem retainer cap 17. As will be noted, this portion is depicted in the FIGS. 21 and 22 and will be discussed hereinafter.

As will be seen from the FIGS. 21 and 22, the closure rocker arm 1015 of the tenth embodiment varies from the closure rocker arm 915 only in that the web portion 1018 extends laterally across the top of the tip of the closure rocker arm rather than across the bottom, and the side flange portions 1020 project downwardly. Thus, whereas the closure rocker arm according to the ninth embodiment accommodated the valve stem retainer cap 17 in the space between the flange portions 920, in the tenth embodiment, the flange portions 1020 are spaced such that when the closure rocker arm is at the bottom of its stroke in the valve opening portion of the engine cycle, the flange portions 1020 extend at either side of the valve stem seal member 14 or in other words the flange portions 1020 define the sides of a cavity in the closure rocker arm 1015 for receiving the valve stem seal member 14 and preventing the closure rocker arm 1015 from impinging on the sealing member 14 so as to achieve the same advantageous results mentioned above in connection with shortening the valve stem and lightening the rocker arm assembly.

Figure 23:
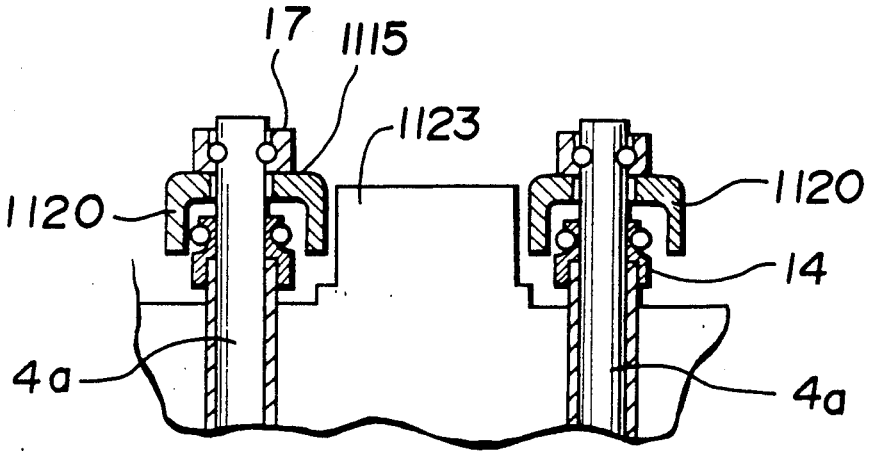
FIG. 23 is an enlarged view showing details of the valve stem engaging portions of the closure arm of the eleventh embodiment of the present invention.

In FIG. 23 the end portions of a closure rocker arm 1115 according to an eleventh embodiment of the invention are depicted. As can be seen the ends of the rocker arm 1115 have exactly the same configuration as the end portion of the rocker arm 1015 the only difference being that there are two valve engaging end portions for operating two poppet valve 4 rather than one poppet valve. It will be noted that in the FIG. 23 embodiment an alignment block 1123 is provided between the end portions of the closure rocker arm 1115 for engaging the inner side portions thereof for eliminating sway in the rocker arm 1115.

It will be readily appreciated from the above disclosure that the inventive elements of the instant invention are not limited to the above configurations and that various recombinations of specific elements of the embodiments described above may be performed to advantage.

What is claimed is:

1. A valve train for an internal combustion engine comprising:

a cam shaft, said cam shaft being operatively connected with a crank shaft of said engine;

an opening cam, said opening cam being formed so as to have a cam profile which varies along the axis of said cam shaft;

a closure cam, said closure cam being formed so as to have a cam profile which varies along the axis of said cam shaft;

axial driving means for driving said cam shaft along its axis;

an opening rocker arm, said opening rocker arm having formed thereon a valve stem engaging portion for engaging a valve stem of a poppet valve and for exerting a force thereon in an opening direction;

an opening cam follower, said opening cam follower being formed on said opening rocker arm for direct engagement with said opening cam;

a closure rocker arm, said closure rocker arm having formed thereon a valve stem engaging portion for engaging said valve stem of said poppet valve and for exerting a force thereon in a valve closing direction;

a closure cam follower, said closure cam follower being formed on said closure rocker arm for direct engagement with said closure arm; and wherein one of either said opening or closure rocker arms is pivotably connected to the cylinder head and the other of said opening or closure rocker arms is pivotably connected to said one rocker arm so as to be relatively pivotable, said one and the other rocker arms being pivotable at separate and distinct locations.

2. A valve train for an internal combustion engine as set forth in claim 1 wherein said closure cam follower and said opening cam follower have convex crowns.

3. A valve train for an internal combustion engine as set forth in claim 1 wherein the profile of said closure cam is such that, when said valve stem is urged in the closing direction by the closure rocker arm in response to the rotation of said cam shaft, it moves in a manner which causes said valve stem to exert a force on said valve stem engaging portion of said opening rocker and causes said opening cam follower to be maintained in one of engagement and near engagement with a non-thrust face portion of said opening cam.

4. A valve train for an internal combustion engine comprising:

a cam shaft, said cam shaft being operatively connected with a crank shaft of said engine;

an opening cam;

a closure cam;

an opening rocker arm, said opening rocker arm having formed thereon a valve stem engaging portion for engaging a valve stem of a poppet valve and for exerting a force thereon in an opening direction;

an opening cam follower, said opening cam follower being formed on said opening rocker arm for engagement with said opening cam;

a closure rocker arm, said closure rocker arm having formed thereon a valve stem engaging portion for engaging said valve stem of said poppet valve and for exerting a force thereon in a valve closing direction, said closure rocker arm being pivotally mounted on said opening rocker arm so as to pivot with respect thereto along a first axis;

a closure cam follower, said closure cam follower being formed on said closure rocker arm for engagement with said closure cam; and a pair of ball and socket pivots, said pair of ball and socket pivots pivotably coupling one of said opening and said closing rocker arms to a cylinder head and defining a second pivoting axis about which said one of said rocker arms pivots with respect to said cylinder head.

5. A valve train as claimed in claim 4 wherein said closure rocker arm includes:

a valve stem enclosure portion, said valve stem enclosure portion comprising a horizontally extending web portion; and a flange portion, said flange portion extending at a side of said horizontally extending web portion at substantially a right angle thereto for stiffening said web portion, said web portion engaging a valve stem of a poppet valve for exerting a force thereon in a valve closing direction.

6. In a variable valve timing arrangement for operating a valve of an internal combustion engine:

a camshaft which is driven to continuously rotate in one rotational direction, said cam shaft being supported in said engine so as to be axially displaceable therein;

servo means for selectively displacing said cam shaft along the axis thereof;

first and second cams mounted on said cam shaft, said first and second cams having first and second predetermined cam configurations;

a first rocker arm operatively interconnecting said valve and said cam shaft, said first rocker arm being arranged to be motivated by direct engagement with said first cam in a manner to open said valve;

a second rocker arm operatively interconnecting said valve and said cam shaft, said second rocker arm being arranged to be motivated by direct engagement with said second cam in a manner to close said valve;

means associated with said first and second rocker arms for obviating movement thereof in the axial direction of said cam shaft; and wherein one of either said opening or closure rocker arms is pivotably connected to the cylinder head and the other of said opening or closure rocker arms is pivotably connected to said one rocker arm so as to be relatively pivotable, said one and the other rocker arms being pivotable at separate and distinct locations.

7. A closure rocker arm for an internal combustion engine comprising:

a valve stem closure portion, said valve stem closure portion comprising a horizontally extending web portion;

a flange portion, said flange portion extending at a side of said horizontally extending web portion at substantially a right angle thereto for stiffening said web portion, said web portion engaging a valve stem of a poppet valve for exerting a force thereon in a valve closing direction; and wherein a pair of said flange portions extend at either side of said web portion and a valve stem seal member is accommodated therebetween.

8. An adjustable valve train for an internal combustion engine comprising:

a cam shaft, said cam shaft being operatively connected with a crank shaft of said engine;

an opening cam, said opening cam being formed so as to have a cam profile which varies along the axis of said cam shaft;

a closure cam, said closure cam being formed so as to have a cam profile which varies along the axis of said cam shaft;

axial driving means or driving said cam shaft along its axis;

an opening rocker arm, said opening rocker arm having formed thereon a valve stem engaging portion for engaging a valve stem of a poppet valve and for exerting a force thereon in an opening direction;

an opening cam follower, said opening cam follower being formed on said opening rocker arm for engagement with said opening cam;

a closure rocker arm, said closure rocker arm having formed thereon a valve stem engaging portion for engaging said valve stem of said poppet valve and for exerting a force thereon in a valve closing direction;

a closure cam follower, said closure cam follower being formed on said closure rocker arm for engagement with said closure cam; and wherein one of said closure rocker arm and said opening rocker arm is pivotally connected to a cylinder head so as to pivot along a first axis and said closure rocker arm and said opening rocker arm are mutually pivotably connected to each other so as to be relatively pivotable along a second axis formed by said pivotal connection.

9. An adjustable valve train for an internal combustion engine as set forth in claim 8 wherein said first pivoting axis is defined to intersect a ball and socket joint by which one of said closure rocker arm and said opening rocker arm is pivotally connected to said cylinder head.

10. An adjustable valve train for an internal combustion engine as set forth in claim 9 wherein a side face of one of said closure rocker arm and said opening rocker arm is engaged by an alignment means for restricting said one of said closure rocker arm and said opening rocker arm pivotally connected to said cylinder head to pivot about said first axis.

11. An adjustable valve train for an internal combustion engine as set forth in claim 8 wherein said first pivoting axis is defined by a pair of ball and socket joints, arranged on a line parallel to said cam shaft, by which one of said closure rocker arm and said opening rocker arm is pivotally connected to said cylinder head.

12. An adjustable valve train for an internal combustion engine as set forth in claim 8 wherein said first pivoting axis is defined by a rocker shaft whose axis extends parallel to said cam shaft, by which one of said closure rocker arm and said opening rocker arm is pivotally connected to said cylinder head.

13. An adjustable valve train for an internal combustion engine as set forth in claim 8 wherein said closure rocker arm is pivotally connected to said cylinder head to pivot at said first axis and said second axis is defined at a central section of said closure rocker arm.

14. An adjustable valve train for an internal combustion engine as set forth in claim 8 wherein said opening rocker arm is pivotally connected to said cylinder head to pivot about said first axis and said second axis is defined at a central section of said rocker arm.

* * * * *